US010773932B2

(12) United States Patent
Ogawa et al.

(10) Patent No.: US 10,773,932 B2
(45) Date of Patent: Sep. 15, 2020

(54) ELECTRIC WINCH DEVICE

(71) Applicants: KOBELCO CONSTRUCTION MACHINERY CO., LTD., Hiroshima-shi (JP); Kobe Steel, Ltd., Kobe-shi (JP)

(72) Inventors: Tetsuya Ogawa, Hyogo (JP); Shintaroh Sasai, Hyogo (JP); Koji Inoue, Kobe (JP); Takashi Hiekata, Kobe (JP)

(73) Assignees: KOBELCO CONSTRUCTION MACHINERY CO., LTD., Hiroshima-shi (JP); Kobe Steel, Ltd., Kobe-shi (JP)

( * ) Notice: Subject to any disclaimer, the term of this patent is extended or adjusted under 35 U.S.C. 154(b) by 6 days.

(21) Appl. No.: 16/332,505

(22) PCT Filed: Sep. 4, 2017

(86) PCT No.: PCT/JP2017/031688

§ 371 (c)(1),
(2) Date: Mar. 12, 2019

(87) PCT Pub. No.: WO2018/056026

PCT Pub. Date: Mar. 29, 2018

(65) Prior Publication Data

US 2019/0256328 A1 Aug. 22, 2019

(30) Foreign Application Priority Data

Sep. 23, 2016 (JP) ..... 2016-185280

(51) Int. Cl.
*B66C 13/22* (2006.01)
*B66C 1/34* (2006.01)
(Continued)

(52) U.S. Cl.
CPC ..... *B66C 13/22* (2013.01); *B66C 1/34* (2013.01); *B66C 13/16* (2013.01); *B66C 15/00* (2013.01);
(Continued)

(58) Field of Classification Search
CPC ..... B66D 1/485; B66D 1/505; B66D 1/54; B66D 1/46; B66C 13/063; B66C 13/085;
(Continued)

(56) References Cited

U.S. PATENT DOCUMENTS 4,331,323 A * 5/1982 Sekimori ..... B60S 11/00 242/390.8
10,343,879 B1 * 7/2019 Felps ..... B66D 1/485
(Continued)

FOREIGN PATENT DOCUMENTS

JP 11-139774 A 5/1999
JP 2007-290799 A 11/2007
(Continued)

OTHER PUBLICATIONS

International Search Report dated Oct. 31, 2017 in PCT/JP2017/031688 filed on Sep. 4, 2017.

*Primary Examiner* — Emmanuel M Marcelo
(74) *Attorney, Agent, or Firm* — Oblon, McClelland, Maier & Neustadt, L.L.P.

(57) ABSTRACT

Provided is an electric winch apparatus capable of preventing irregular winding of a wire rope caused by landing of a hoisted-down suspended load. The electric winch apparatus includes a winch drum (5) around which a wire rope (2) is wound, an electric motor (8) which rotates the winch drum (5), an operation lever (13*a*), a measurement unit (18) which measures a tension index value corresponding to a tension in the wire rope (2), and a controller (12) which controls motion of the electric motor (8). The controller (12) stops motion of the electric motor (8) when an operation in a lowering operation direction is applied the operation lever (13*a*) and a tension average value as an average value of a tension in the wire rope (2) becomes less than or equal to a predetermined tension reference value, the average value of
(Continued)

the tension corresponding to an average value of the tension index value in a predetermined period.

5 Claims, 5 Drawing Sheets

(51) Int. Cl.
*B66C 13/16* (2006.01)
*B66C 15/00* (2006.01)
*B66D 1/50* (2006.01)
*B66D 1/46* (2006.01)

(52) U.S. Cl.
CPC ..... *B66D 1/46* (2013.01); *B66D 1/505* (2013.01); *B66C 2700/08* (2013.01)

(58) Field of Classification Search
CPC ..... B66C 13/105; B66C 13/23; B66C 15/065; B66C 1/34; B66C 2700/08
See application file for complete search history.

(56) References Cited

U.S. PATENT DOCUMENTS

| | | | | |
|---|---|---|---|---|
| 2012/0328408 | A1 | 12/2012 | Sorensen et al. | |
| 2014/0138340 | A1* | 5/2014 | Miller | B66D 3/04 212/336 |
| 2016/0257534 | A1* | 9/2016 | Kawai | B66C 23/905 |
| 2016/0289054 | A1 | 10/2016 | Hiekata et al. | |
| 2017/0066634 | A1* | 3/2017 | Kawai | B66D 1/54 |
| 2017/0210606 | A1* | 7/2017 | Kawai | B60T 8/17 |
| 2018/0105360 | A1* | 4/2018 | Stordal | B65G 1/14 |
| 2018/0201489 | A1* | 7/2018 | Schmidt | B66D 1/741 |
| 2019/0256328 | A1* | 8/2019 | Ogawa | B66C 1/34 |
| 2019/0292026 | A1* | 9/2019 | Felps | B66D 1/485 |
| 2019/0382247 | A1* | 12/2019 | Cui | B66D 1/12 |

FOREIGN PATENT DOCUMENTS

| | | | |
|---|---|---|---|
| JP | 2015-98390 | A | 5/2015 |
| KR | 10-2006-0064123 | A | 6/2006 |
| WO | WO 2011/088832 | A1 | 7/2011 |

* cited by examiner

OPERATION AMOUNT OF LEVER
0
TIME

SPEED COMMAND VALUE
0
TIME

AVERAGE VALUE OF TENSION IN WIRE ROPE
AMOUNT OF SUSPENDED LOAD
AMOUNT OF LOAD BY HOOK
0
TIME

BRAKE
BRAKING STATE
RELEASING STATE
TIME

ROTATIONAL SPEED OF WINCH DRUM
0
TIME

HOOK POSITION
GROUND
t0
t1
t2
t3
TIME

OPERATION AMOUNT OF LEVER
0
TIME

SPEED COMMAND VALUE
0
TIME

AVERAGE VALUE OF TENSION IN WIRE ROPE
AMOUNT OF SUSPENDED LOAD
AMOUNT OF LOAD BY HOOK
TENSION REFERENCE VALUE
0
TIME

BRAKE
BRAKING STATE
RELEASING STATE
TIME

ROTATIONAL SPEED OF WINCH DRUM
0
TIME

HOOK POSITION
GROUND
t0
t1
t2
t3
TIME

ELECTRIC WINCH DEVICE

CROSS-REFERENCE TO RELATED APPLICATIONS

This patent application is a U.S. national stage application of International Application No. PCT/JP2017/031688, filed Sep. 4, 2017 and the entire contents of which are incorporated herein by reference, which claims priority to JP 2016-185280, filed Sep. 23, 2016 and the entire contents of which are incorporated herein by reference.

TECHNICAL FIELD

The present invention relates to an electric winch apparatus mounted on a construction machine.

BACKGROUND ART

In general, around a winch drum for use in a construction machine such as a crane, a wire rope is wound in an aligned state. This prevents the wire rope to be drawn out from a winch drum or wound up by the winch drum from being twisted or bent and makes it possible to restrict portions of the wire rope from coming into unnecessary contact with each other, as a result, enabling the wire rope to have extended life.

It is conventionally known that irregular winding occurs during lowering a suspended load. The irregular winding is a phenomenon in which the aligned state of portions of a wire rope in a winch drum is disturbed. The irregular winding during lowering a suspended load is caused by rotation of the winch drum while some factor causes a wire rope to slack.

Patent Literature 1 below discloses a technique for preventing irregular winding of a wire rope during lowering a suspended load in a winch apparatus. Specifically, Patent Literature 1 discloses an irregular-winding prevention device for preventing irregular winding of a wire rope at the start of lowering operation of a winch drum. The irregular-winding prevention device compares a real rope tension acting on the wire rope drawn out from the winch drum and an irregular-winding generating tension set in advance and restrict the maximum rotational speed of a hydraulic motor rotating the winch drum when the real rope tension is less than or equal to the irregular winding generating tension, to prevent the real rope tension from being less than or equal to the irregular winding generating tension, thereby preventing the wire rope from slacking to prevent irregular winding.

On the other hand, as a new winch apparatus different from a conventional hydraulic winch apparatus, there has been developed an electric winch apparatus having an electric motor to drive a winch drum. This electric winch apparatus also has a problem of irregular winding of a wire rope that occurs during lowering a suspended load. In particular, found is a phenomenon that there occurs a slack in a wire rope to involve the irregular winding when the lowered suspended load reaches the ground, and demanded is a technique for preventing the irregular winding of a wire rope caused upon the landing of a suspended load.

The above technique of Patent Literature 1 is a technique for preventing irregular winding caused at the start of lowering operation of a winch drum, being hard to be used for preventing irregular winding from occurring upon landing of a suspended load. In addition, the technique for preventing irregular winding recited in Patent Literature 1 is premised on control of a hydraulic motor in a hydraulic winch apparatus, thus being inapplicable to an electric winch apparatus.

CITATION LIST

Patent Literature 1: Unexamined Japanese Patent Publication No. H11-139774

SUMMARY OF INVENTION

An object of the present invention is to provide an electric winch apparatus capable of preventing irregular winding caused by landing of a lowered suspended load.

Provided is an electric winch apparatus to be mounted on a construction machine, the electric winch apparatus including: a winch drum around which a wire rope for suspending a suspended load is wound; an electric motor capable of rotating the winch drum by applying a torque to the winch drum in both of a lifting direction that is a rotational direction to lift up the suspended load and a lowering direction that is a rotational direction to lower the suspended load; an operation unit displaceable, from a reference position, in both of a lifting operation direction that is an operation direction for providing instruction on lifting up the suspended load and a lowering operation direction that is an operation direction for providing instruction on lowering the suspended load, the operation unit being configured to receive an operation of a lifting operation that displaces the operation unit in the lifting operation direction and a lowering operation that displaces the operation unit in the lowering direction; a measurement unit that measures a tension index value that is an index value of a tension in the wire rope; and a controller that controls a motion of the electric motor to rotate the winch drum in the lifting direction or the lowering direction according to the operation applied to the operation unit. The controller executes stop processing of stopping the motion of the electric motor in a case where a tension average value that is an average value of a tension in the wire rope becomes less than or equal to a predetermined tension reference value, the average value of the tension corresponding to an average value of the tension index value measured by the measurement unit in a predetermined period, in a state that the operation unit is operated in the lowering operation direction.

DESCRIPTION OF EMBODIMENTS

Figure 1:
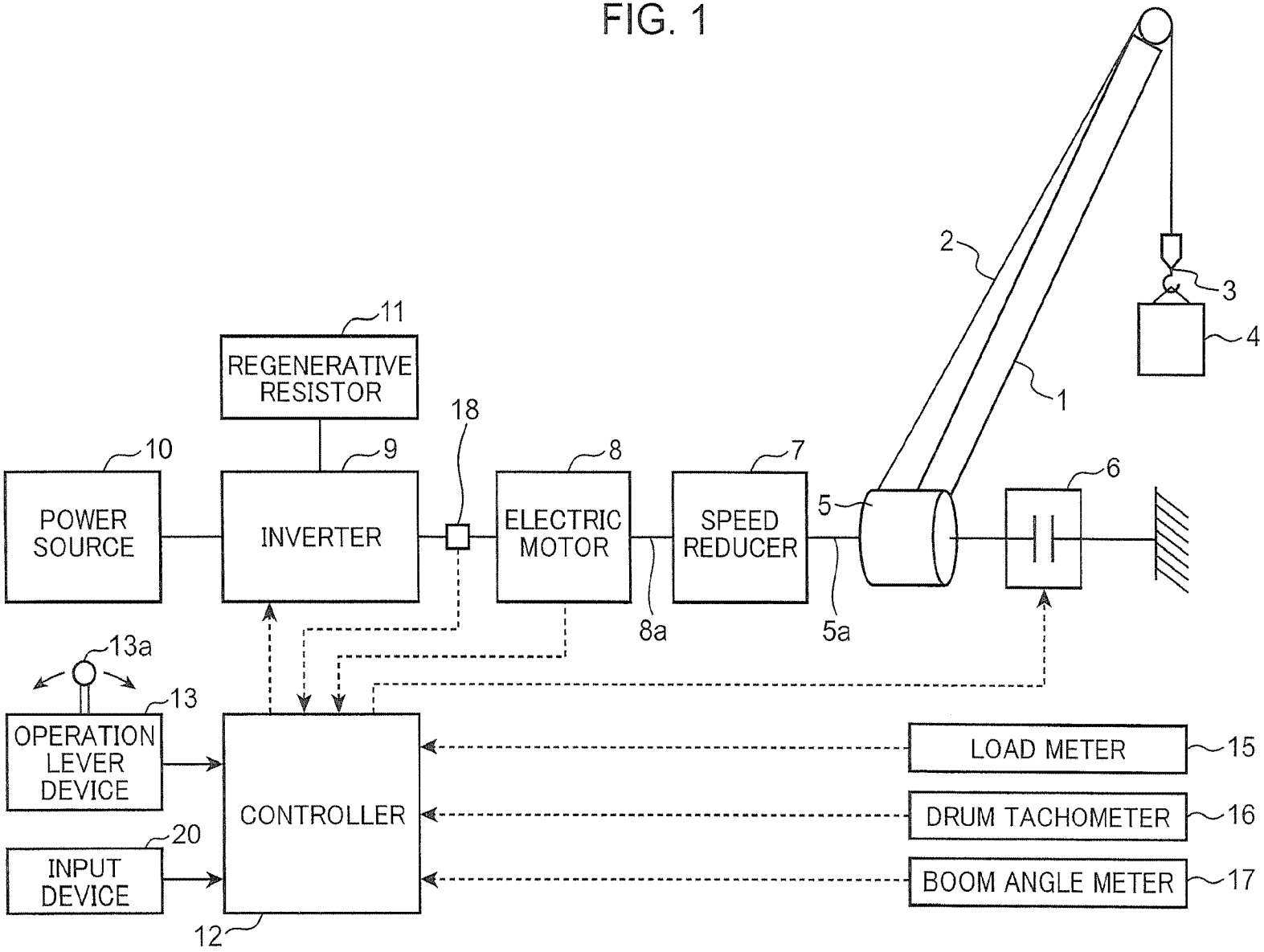
FIG. 1 is a diagram showing a configuration of an electric winch apparatus according to one embodiment of the present invention.

FIG. 1 shows a configuration of an electric winch apparatus according to one embodiment of the present invention. The electric winch apparatus according to the present embodiment is provided to a crane as a construction machine to conduct lifting or lowering of a suspended load 4.

The crane includes a crane main body not shown, a boom 1 supported by the crane main body so as to be capable of being derricked, and the electric winch apparatus. The boom 1 has a distal end from which a hook 3 is suspended through a wire rope 2. The hook 3 is connected to a front end of the wire rope 2, and the suspended load 4 is hooked on the hook 3 to be suspended. The electric winch apparatus is installed on the crane main body.

The electric winch apparatus includes a winch drum 5, a brake 6, a speed reducer 7, an electric motor 8, an inverter 9, a power source 10, a regenerative resistor 11, a controller 12, an operation lever device 13, a load meter 15, a drum tachometer 16, a boom angle meter 17, an ammeter 18, and an input device 20. The electric motor 8 is capable of rotating the winch drum 5 in both of a lifting direction and a lowering direction to thereby lifting up and lowering the suspended load 4 through the wire rope 2.

The wire rope 2 is wound around the winch drum 5. The electric motor 8 has a rotating shaft 8*a* to which the winch drum 5 is connected through the speed reducer 7. The winch drum 5 is rotated by a torque applied from the electric motor 8. The winch drum 5 has a rotating shaft 5*a*.

The brake 6 is connected to the rotating shaft 5*a* to brake rotation of the winch drum 5. The brake 6 is a mechanical brake selectable between a braking state of braking the rotation of the winch drum 5 and a releasing state of releasing the braking of the winch drum 5 under the control by the controller 12. As the brake 6 is adopted, for example, a band type or a wet disk type of brake.

The winch drum 5 takes up the wire rope 2 through its rotation in the lifting direction to thereby lift up the suspended load 4. The winch drum 5 draws out the wire rope 2 through its rotation in the lowering direction reverse to the lifting direction to thereby lower the suspended load 4.

The electric motor 8 is, for example, a three-phase motor. The electric motor 8 is electrically connected to the inverter 9, which is electrically connected to the power source 10. In short, the electric motor 8 is electrically connected to the power source 10 via the inverter 9. The electric motor 8 is driven by electric power which is supplied from the power source 10 through the inverter 9 and controlled by the inverter 9, being capable of applying a torque corresponding to the electric power to the winch drum 5 to thereby drive the winch drum 5 in both of the lowering direction and the lifting direction. The torque is transmitted from the electric motor 8 to the rotating shaft 5*a* of the winch drum 5 via the rotating shaft 8*a* and the speed reducer 7, thereby rotating the winch drum 5 in the lifting direction or the lowering direction.

The inverter 9 is formed of, for example, a three-phase inverter including a plurality of switching elements two of which are assigned to each of U, V, and W phases, namely, a total of six switching elements. The inverter 9 controls the motion of the electric motor 8 according to a control signal input from the controller 12.

The speed reducer 7 transmits rotational force of the rotating shaft 8*a* to the rotating shaft 5*a* of the winch drum 5 while reducing a rotational speed of the rotating shaft 8*a* of the electric motor 8 at a predetermined reduction ratio.

The power source 10 is, for example, a battery mounted on a crane. The power source 10 may be, alternatively, an external power source connected to a plug-in terminal mounted on the crane.

The regenerative resistor 11 is electrically connected to the inverter 9. The regenerative resistor 11 consumes surplus portion of electric power that the power source 10 cannot regenerate, thereby conducting electric power adjustment. In the present embodiment, regenerative brake is applied to the electric motor 8 through the function of the regenerative resistor 11.

The controller 12 is formed of, for example, a computer including a CPU, a ROM, and a RAM. The operation lever device 13 has an operation lever 13*a* as one example of an operation unit capable of being displaced in both of the lowering operation direction and the lifting operation direction from a neutral position as described later. The controller 12 controls the inverter 9 to bring the electric motor 8 into motion at a rotational speed according to a lever operation amount that is a displacement amount of the operation lever 13*a* by the operation applied to the operation lever 13*a*. The controller 12 brings the brake 6 into the braking state when the operation lever 13*a* is at the neutral position and brings the brake 6 into the releasing state according to the operation applied to the operation lever 13*a* to displace the operation lever 13*a* in the lowering operation direction or the lifting operation direction from the neutral position.

To the controller 12, a plurality of sensors are connected, including the load meter 15, the drum tachometer 16, the boom angle meter 17, and the ammeter 18. The controller 12 grasps a state of the suspended load 4 based on respective measured values by the load meter 15, the drum tachometer 16, and the boom angle meter 17.

The controller 12 obtains, from the ammeter 18, a measured value of a current to be supplied to the electric motor 8 by the inverter 9, calculating a torque generated in the winch drum 5 from the obtained measured value of current.

The operation lever device 13 is a device for providing instructions on lifting and lowering of the suspended load 4. To the operation lever 13*a* of the operation lever device 13, given is either of the operation for causing the winch drum 5 to be rotated in the lifting direction of the suspended load 4 and the operation for causing the winch drum 5 to be rotated in the lowering direction of the suspended load 4. The operation lever 13*a* is one example of the operation unit in the present invention. The operation lever 13*a* is operated so as to be tilted, for example, forward and backward or rightward and leftward, from the neutral position. The neutral position is one example of a reference position of the operation lever in the present invention. Of the operations to be applied to the operation lever 13*a*, the operation of displacing the operation lever 13*a* in the lowering operation direction from the neutral position is the lowering operation for providing the instruction on lowering the suspended load 4 and the operation of displacing the operation lever 13*a* in the lifting operation direction, which is a direction reverse to the lowering operation direction, from the neutral position is the lifting operation for providing the instruction on lifting the suspended load 4.

Upon the application of the operation of displacing the operation lever 13*a* in the lowering operation direction from the neutral position (that is, the lowering operation, e.g. inclination operation) to the operation lever 13*a*, the operation lever device 13 generates a signal indicating an operation amount (e.g. angle of inclination) that is a displacement amount of the operation lever 13*a* from the neutral position, inputting the signal to the controller 12. Upon the application of the operation of displacing the operation lever 13*a* in the lifting operation direction from the neutral position (that is, the lifting operation, e.g. inclination operation), the operation lever device 13 generates a signal indicating an operation amount (e.g. angle of inclination) that is a displacement amount of the operation lever 13*a* from the neutral position, inputting the signal to the controller 12 The operation amount of the operation lever 13*a* in the lowering operation direction and the operation amount of the operation lever 13*a* in the lifting operation direction are given a negative sign and a positive sign, respectively. The signs enable the operation direction of the operation lever 13*a* to be discriminated.

The load meter 15 is attached to, for example, a derricking rope which keeps the derricking posture of the boom 1 or to a not-graphically-shown derricking drum to derrick the boom 1 through the derricking rope. The load meter 15 measures a load applied to the derricking rope and a load applied from the derricking rope to the derricking drum. The measured value of the load measured by the load meter 15 is used for estimating a tension in the wire rope 2 and/or respective weights of the suspended load 4 and the hook 3 in a state where the suspended load 4 is stopped. The controller 12 sequentially obtains the measured value of the load meter 15 and calculates the tension in the wire rope 2 and the weights of the suspended load 4 and the hook 3 from the obtained measured values with use of a predetermined calculation formula.

The drum tachometer 16 sequentially detects the number of rotations of the winch drum 5 per unit time and sequentially inputs data of the detected number of rotations to the controller 12.

The boom angle meter 17 sequentially detects a derricking angle of the boom 1 and sequentially inputs data of the detected derricking angle to the controller 12.

The ammeter 18 sequentially measures a value of a current supplied from the inverter 9 to the electric motor 8 and sequentially inputs data of the measured current value to the controller 12. The ammeter 18 is provided in, for example, an electric power line interconnecting the inverter 9 and the electric motor 8. The ammeter 18 is one example of a measurement unit in the present invention, and the current value measured by the ammeter 18 is one example of a tension index value in the present invention.

The input device 20 is a device used by an operator to input designation of the motion mode of the electric winch apparatus to the controller 12. The input device 20 is, for example, a touch panel type or other type input device disposed in a cab. As the motion mode of the electric winch apparatus, provided are a normal work mode for conducting normal crane work (suspending work) in the crane, a draw-out mode for causing the winch drum 5 to draw out the wire rope 2 not for the purpose of lowering the suspended load 4, a free-fall mode for conducting free-fall of the suspended load 4, and the like. The input device 20 inputs designation of one motion mode selected from the plurality of motion modes, to the controller 12.

Of respective inputs of the motion modes to be input to the controller 12 by the input device 20, the input of designation of the motion modes other than the draw-out mode, namely, each input of designation of the normal work mode, the free-fall mode, and the like, is cane example of stop input for providing, instructions on execution of stop processing on the electric motor 8 upon the landing of the suspended load 4 in the present invention. The case where the input device 20 inputs designation of not the normal work mode or the free-fall mode but the draw-out mode is one example of the case where the input device 20 does not receive stop input in the present invention.

The operator selects a desired motion mode from the plurality of the provided motion modes and inputs a mode designation signal for designating the selected motion mode to the controller 12 with use of the input device 20. The controller 12 conducts control of the electric motor 8 according to the motion mode corresponding to the mode designation signal input from the input device 20. When receiving input of designation of a motion anode other than the draw-out mode from the input device 20, that is, when the mode designation signal input from the input device 20 to the controller 12 is a signal which designates a motion mode other than the draw-out mode, the controller 12 executes the stop processing of stopping the electric motor 8. When the mode designation signal input from the input device 20 is not one to designate the draw-out mode, the controller 12 does not execute the stop processing. Thus, in the present embodiment, the motion modes of the electric winch apparatus and execution/non-execution of the stop processing of the electric motor 8 are correlated with each other.

Figure 2:
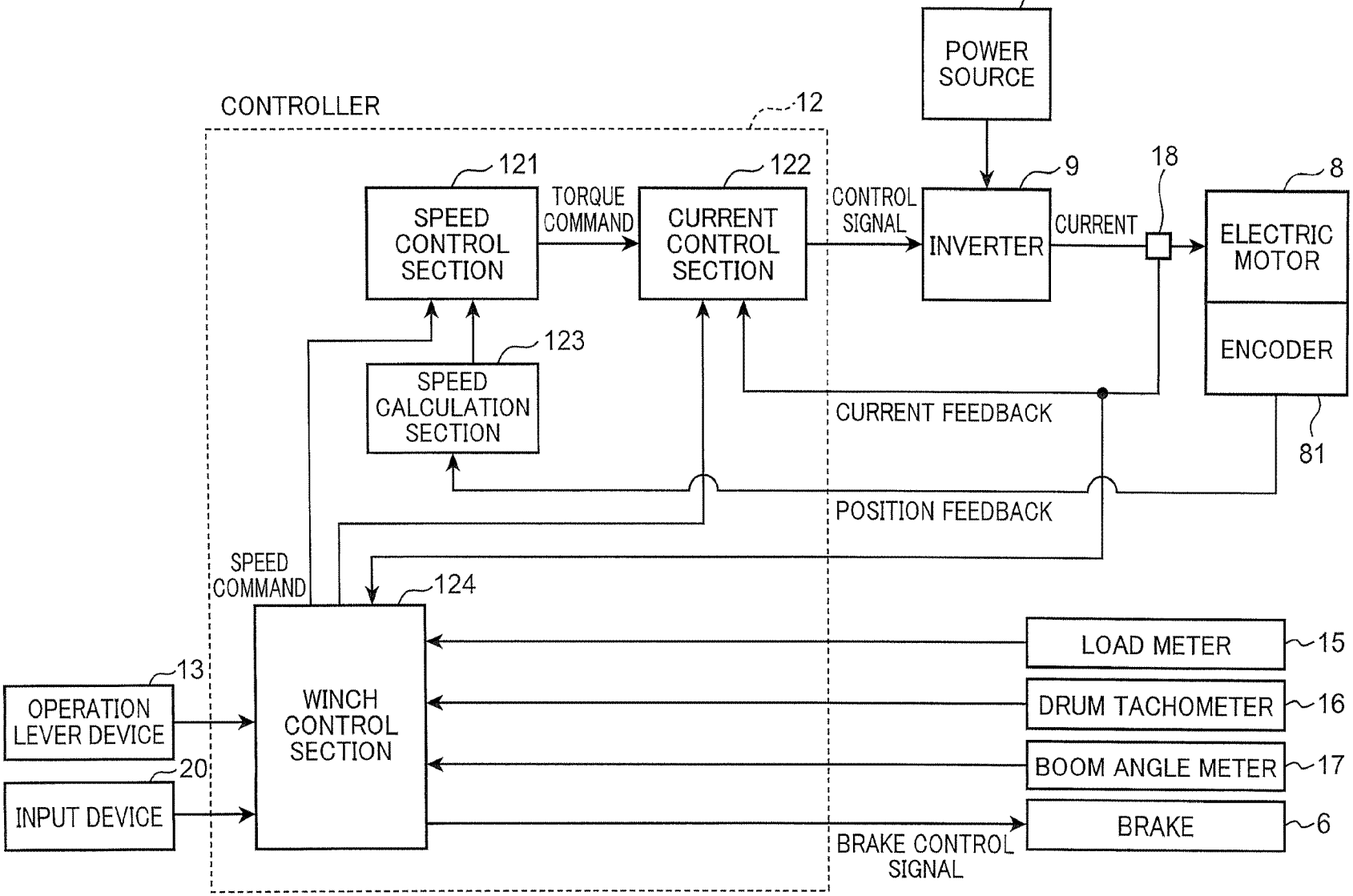
FIG. 2 is a block diagram showing an internal configuration of a controller of the electric winch apparatus shown in FIG. 1.

FIG. 2 is a block diagram showing a function of the controller 12 of the electric winch apparatus shown in FIG. 1. The controller 12 includes a speed control section 121, a current control section 122, a speed calculation section 123, and a winch control section 124. The controller 12 is capable of controlling a speed of the electric motor 8 so as to operate the electric motor 8 at a rotational speed according to the operation amount of the operation lever 13*a*.

The speed control section 121 generates such a torque command as to make a deviation be 0 between the rotational speed of the electric motor 8 input from the speed calculation section 123 and the speed command value input from the winch control section 124, and inputs the torque command to the current control section 122. In the present embodiment, a negative sign and a positive sign are given to a rotational speed of the electric motor 8 in a direction of rotating the winch drain 5 in the lowering direction and a rotational speed of the electric motor 8 in a direction of rotating the winch drum 5 in the lifting direction, respectively, the signs making it possible to judge whether the rotational speed of the electric motor 8 is a speed in the lifting direction or a speed in the lowering direction. Corresponding thereto, a negative sign and a positive sign are given to a speed command value with respect to the lowering direction and a speed command value with respect to the lifting direction, respectively, the signs making it possible to judge whether the speed command value is a command value in the lowering direction or a command value in the lifting direction.

The current control section 122 determines a target current value based on a torque command input from the speed control section 121 and generates a control signal for making a deviation be 0 between the determined target current value and the current value measured by the ammeter 18, inputting the control signal to the inverter 9.

The control signal is constituted by a plurality of different phase control signals corresponding to, for example, U, V, and W phases, respectively, the plurality of different phase control signals being input to respective control terminals of the switching elements of U, V, and W phases that constitute the inverter 9. The control terminal of the switching element is, for example, a gate or a base of a transistor.

The speed calculation section 123 receives information about a position of a rotor in the electric motor 8 and calculates a rotational speed of the electric motor 8 by time-differentiation of the position. The electric motor 8 includes, for example, a built-in encoder 81, and the information about the position is sequentially input from the encoder 81 to the speed calculation section 123.

The winch control section 124 stores, for example, a speed command map defining a relation between the operation amount of the operation lever 13*a* and the speed command value, and determines, with use of the speed command map, the speed command value corresponding to the operation amount of the operation lever 13*a* indicated by the signal input from the operation lever device 13, inputting the determined speed command value to the speed control section 121. The speed command value is, for example, a value which is 0 when the operation lever 13*a* is at the neutral position, the value being increased in a minus direction with increase in the amount of operation (e.g. amount of tilt) of the operation lever 13*a* in the lowering operation direction from the neutral position and being increased in a plus direction with increase in the amount of operation (e.g. amount of tilt) of the operation lever 13*a* in the lifting direction from the neutral position.

The winch control section 124 inputs the brake control signal for bringing the brake 6 into the braking state, to the brake 6, when the operation lever 13*a* is at the neutral position, that is, when the operation amount of the operation lever 13*a* indicated by the signal input from the operation lever device 13 is 0. The winch control section 124 inputs the brake control signal for bringing the brake 6 into the releasing state, to the brake 6, when the operation lever 13*a* is operated in the lowering operation direction or in the lifting operation direction from the neutral position, that is, when the absolute value of the operation amount of the operation lever 13*a* indicated by the signal input from the operation lever device 13 is increased from 0.

Furthermore, the winch control section 124 grasps the state of the suspended load 4 based on respective measured values input from the load meter 15, the drum tachometer 16, and the boom angle meter 17.

The encoder 81 is one example of a motor tachometer, being, for example, a rotary encoder. The encoder 81 sequentially measures an amount of rotation of the rotor of the electric motor 8 from a reference position as position information and sequentially inputs the position information on the measured amount of rotation to the speed calculation section 123.

In addition to the above described basic control operation, the controller 12 according to the present embodiment executes the stop processing, that is, processing of stopping the motion of the electric motor 8 so as to, stop rotation of the winch drum 5 in the lowering direction in accordance with the landing of the suspended load 4.

Specifically, the controller 12 conducts: calculating a torque to be applied to the winch drum 5 by the electric motor 8 based on a current value measured by the ammeter 18, as a value corresponding to the tension in the wire rope 2; calculating an average value of the torque in a predetermined period (a predetermined time length), as a value corresponding to the average value of the tension in the wire rope 2 in the predetermined period; and executing the stop processing, that is, the processing of causing the inverter 9 to stop the motion of the electric motor 8, when the average value of the tension corresponding to the calculated torque average value as described above becomes less than or equal to a predetermined tension reference value while the operation lever 13*a* is operated in the lowering operation direction.

The controller 12 calculates a torque to be applied from the electric motor 8 to the winch drum 5, for example, as follows. In the case where the ammeter 18 measures, for example, respective current values of U, V, and W phases, the winch control section 124 converts the measured values of the currents of the U, V, and W phases input from the ammeter 18 to respective current values of a d-axis and a q-axis and calculates the value obtained by multiplying the current value of the q-axis by a predetermined conversion coefficient, as a torque corresponding to the tension in the wire rope 2. In this case, the ammeter 18 corresponds to one example of the measurement unit in the present invention. The conversion coefficient is a coefficient for converting the current value on the q-axis into the torque to be applied to the winch drum 5. As the conversion coefficient, a value is adopted in consideration of the reduction ratio of the speed reducer 7 and the mechanical influence by the speed reducer 7.

Next will be described about the control conducted in the electric winch apparatus according to the present embodiment for prevention of irregular winding of the wire rope 2 upon the landing of the suspended load 4, with reference to the flow chart shown in FIG. 3.

Figure 3:
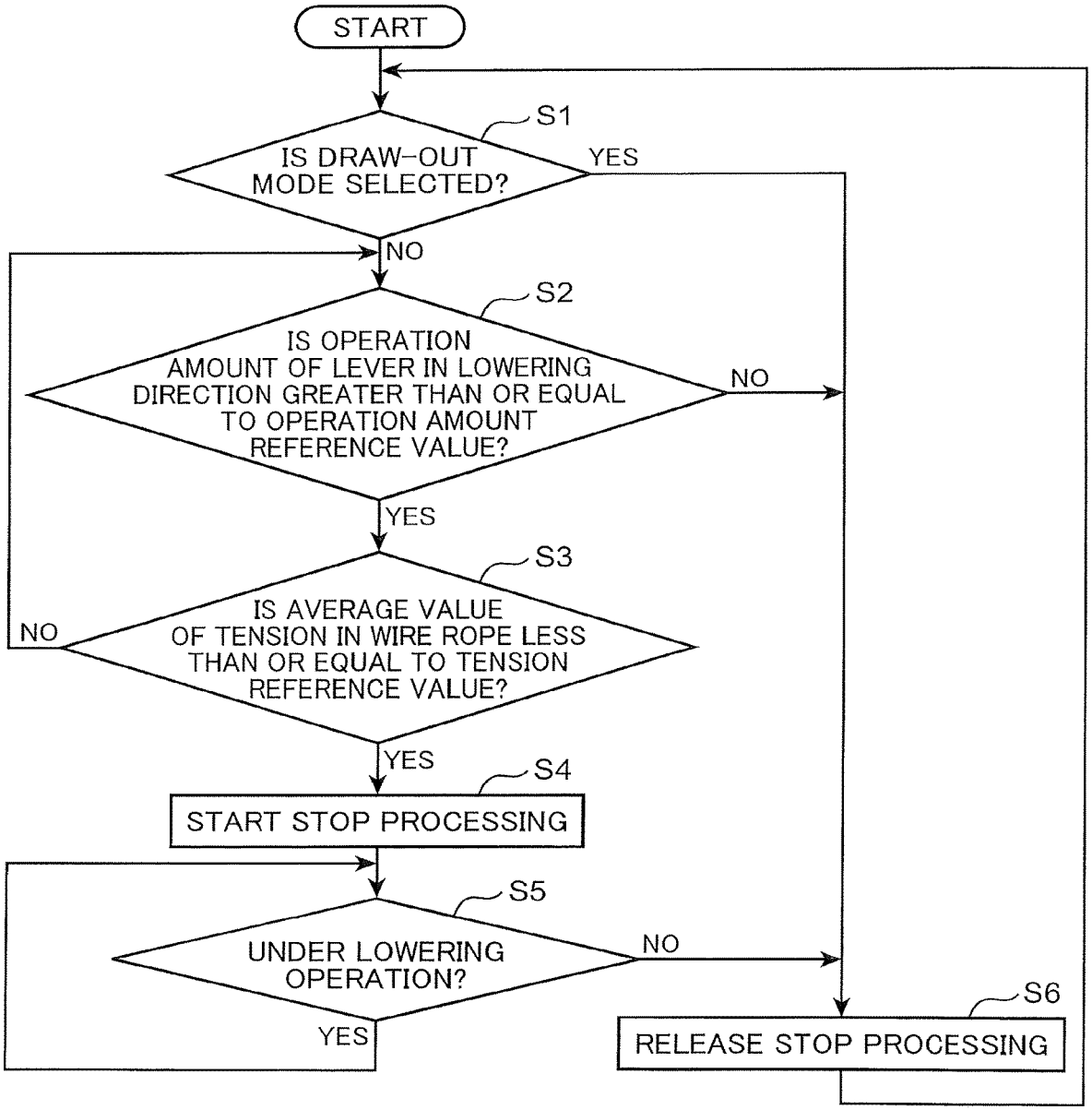
FIG. 3 is a flow chart of control for preventing irregular winding of the electric winch apparatus according to the present embodiment.

First, the controller 12 judges whether the draw-out mode is selected as the motion mode of the electric winch apparatus (step S1 in FIG. 3). Specifically, the controller 12 judges that the draw-out mode is selected as the motion mode of the electric winch apparatus in the case where the mode designation signal input from the input device 20 to the controller 12 is one for designating the draw-out mode. In contrast, in the case where the mode designation signal input from the input device 20 to the controller 12 designates any motion mode other than the draw-out mode, the controller 12 judges that the draw-out mode is not selected as the motion mode of the electric winch apparatus.

When judging that the draw-out mode is not selected as the motion mode of the electric winch apparatus, in other words, that a motion mode other than the draw-out mode is selected (NO in step S2), the controller 12 then judges whether the operation amount of the operation lever 13*a* in the lowering direction from the neutral position is greater than or equal to the predetermined operation-amount reference value (step S2). On the other hand, when judging that the draw-out mode is selected as the motion mode of the electric winch apparatus (YES in step S2), the controller 12 releases the stop processing of the electric motor 8 for stopping rotation of the winch drum 5 in the lowering direction (to be described later; step S6). The release of the stop processing is conducted in order to allow the wire rope 2 to be drawn out by release of the function of the stop processing of the electric motor 8 when the operator selects the draw-out mode to cause the winch drum 5 to draw out the wire rope 2 in view of the state of the crane and work contents.

In the above step S2, the controller 12 reads the operation amount of the operation lever 13*a* indicated by the signal input from the operation lever device 13, and judges whether the operation amount is greater than or equal to the operation amount reference value. When judging that the operation amount of the operation lever 13*a* is greater than or equal to the operation amount reference value (YES in step S2), the controller 12 then judges whether the average value of the tension in the wire rope 2 in the predetermined period, that is, the tension average value corresponding to the average value of the torque, is less than or equal to the predetermined tension reference value (step S3). On the other hand, when judging that the operation amount of the operation lever 13*a* is less than or equal to the operation amount reference value (NO in step S2), the controller 12 conducts the release of the stop processing, that is, the release of the processing of stopping the electric motor 8 in order to stop the rotation of the winch drum 5 in the lowering direction as detailed later (step S6). The release of the stop processing makes it possible to suspend the stop processing of the electric motor 8, when the operation amount of the operation lever 13*a* in the lowering operation direction is so minute as to be less than the operation amount reference value, to allow the winch drum 5 to make a minute rotation in the lowering direction corresponding to the minute operation.

Figures 5A, 5B, 5C, 5D, 5E, 5F:
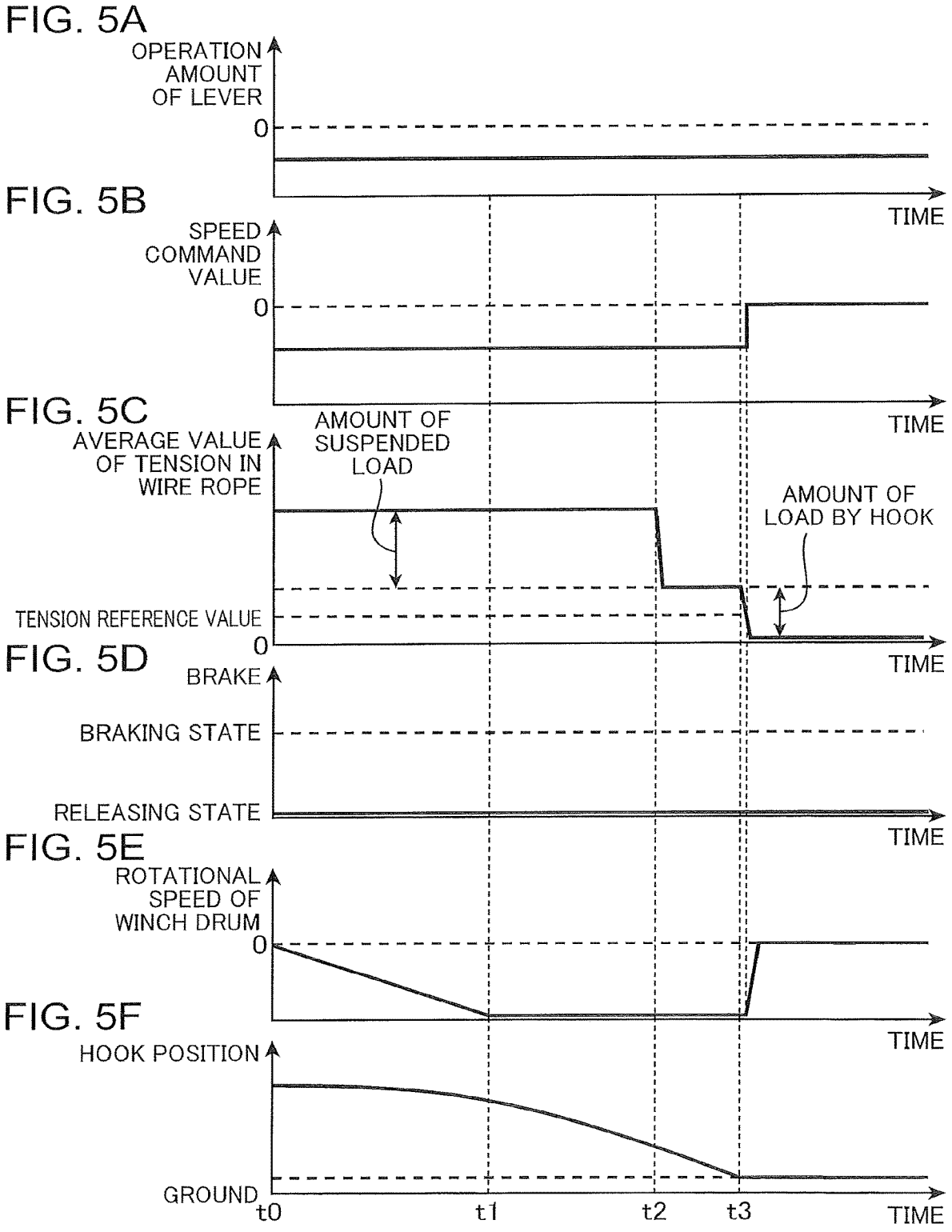
FIG. 5 is a waveform diagram showing behavior of the electric winch apparatus according to the present embodiment when the suspended load lands in the course of lowering operation of the suspended load.

Although not shown in FIG. 5, the controller 12 sequentially calculates the torque to be applied to the winch drum 5 by the electric motor 8 based on the current value measured by the ammeter 18 as a value corresponding to the tension in the wire rope 2 and calculates the average value of the torque in the predetermined period as a value corresponding to the average value of the tension in the wire rope 2 in the predetermined period as described above. In the above step S3, the controller 12 judges whether the tension corresponding to the thus calculated average value of the torque is less than or equal to the predetermined tension reference value. The tension reference value is determined to be a value smaller than the load corresponding to the weight of the hook 3. In reality, the judgement may be made based on direct comparison between the tension average value corresponding to the average value of the torque and the tension reference value, or based on comparison between the average value of the torque and the torque reference value corresponding to the tension reference value. The above-described use of the average value of torque as the value corresponding to the average value of the tension in the wire rope 2 makes it possible to exclude a possibility of executing the stop processing of the electric motor 8 because of the instantaneous load change due to instantaneous vibration or noise, blast by wind, or the like.

When the average value of the tension in the wire rope 2 is less than or equal to the tension reference value, the controller 12 starts the stop processing, that is, the processing of stopping the electric motor 8 for stopping rotation of the winch drum 5 in the lowering direction (step S4). In contrast, when the average value of the tension is greater than the tension reference value, the controller 12 repeats the processing of the above step S2 and the subsequent steps.

The stop processing of the electric motor 8 is triggered by the input of the speed command value of 0 to the speed control section 121 by the winch control section 124 of the controller 12, even though an operation is applied to the operation lever 13*a* in the lowering operation direction, that is, even though a signal indicating a minus operation amount is input from the operation lever device 13. This involves the speed control of the electric motor 8 to make the rotational speed of the electric motor 8 be 0. In summary the control is conducted to stop the motion of the electric motor 8, in spite of the operation applied to the operation lever 13*a* in the lowering operation direction.

Following the start of the stop processing, the controller 12 judges whether the operation lever 13*a* is still under the lowering operation (step S5). Specifically, the controller 12 judges whether the operation amount of the operation lever 13*a* in the lowering operation direction is greater than or equal to the operation amount reference value, the operation amount being indicated by the signal input from the operation lever device 13. The controller 12 does not release the stop processing as long as the operation amount of the operation lever 13*a* in the lowering direction is greater than or equal to the operation amount reference value, that is, as long as the lowering operation is applied to the operation lever 13*a* (NO in step S5), and starts the release of the stop processing of the electric motor 8 at a time point when the operation amount of the operation lever 13*a* in the lowering direction becomes less than the operation amount reference value (NO in step S5) (step S6).

The release of the stop processing is conducted by the winch control section 124. Specifically, the winch control section 124 inputs a value according to the operation amount of the operation lever 13*a* from the neutral position as the speed command value to the speed control section 121. The release of the stop processing allows a speed control of the electric motor 8 to be conducted to make the rotational speed of the electric motor 8 be a speed corresponding to the operation amount of the operation lever 13*a*. After the release of the stop processing (step S6), the processing, in the above step S1 and the subsequent steps are repeated.

Figures 4A, 4B, 4C, 4D, 4E, 4F:
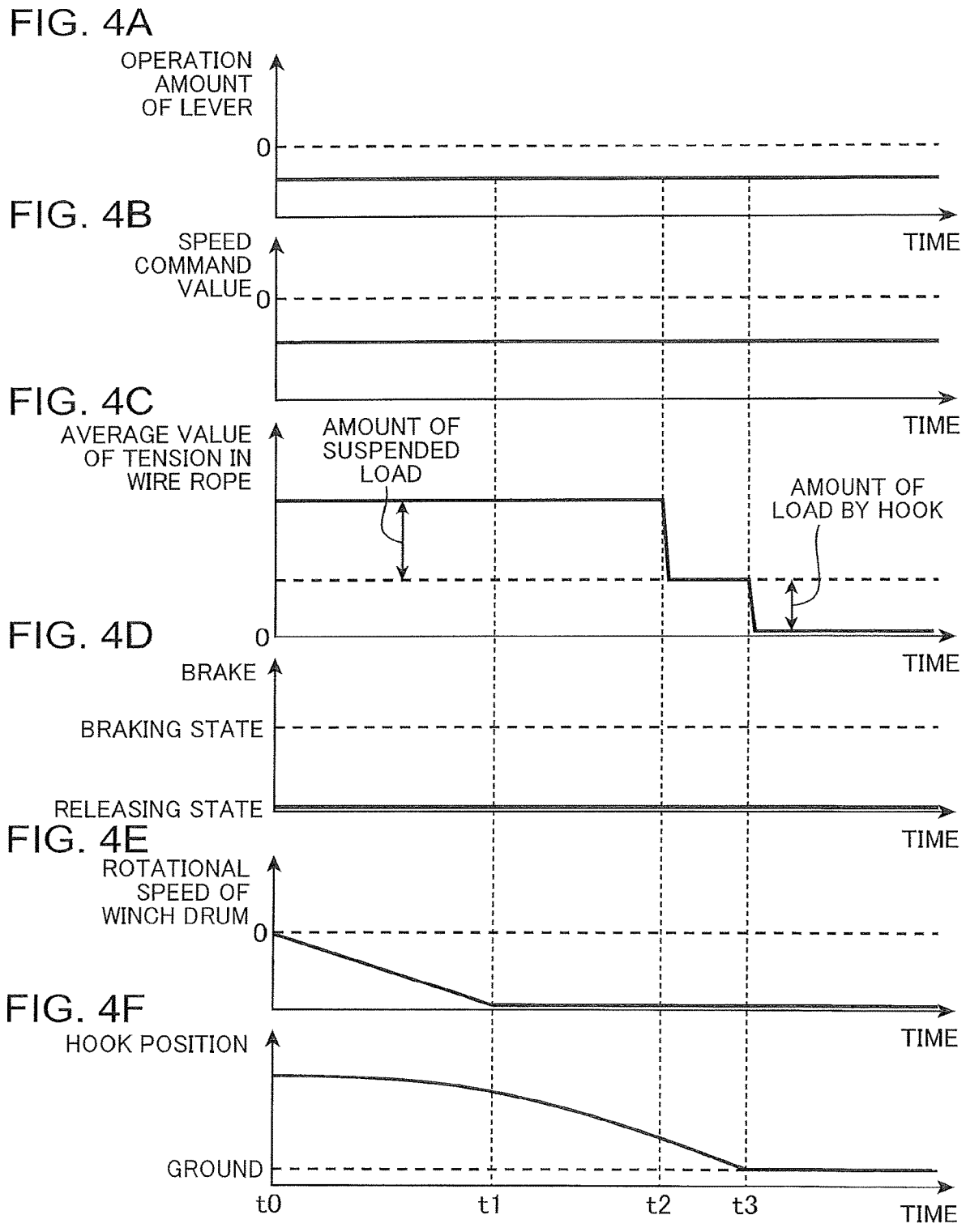
FIG. 4 is a waveform diagram showing behavior of the electric winch apparatus in a case without applying a technique for preventing irregular winding of the electric winch apparatus according to the present embodiment when a suspended load lands in the course of lowering operation of the suspended load.

Next will be described the behavior of the electric winch apparatus according to the present embodiment when the control is conducted to prevent irregular winding upon the landing of the suspended load 4 as described above during the lowering operation of the suspended load 4, with reference to FIGS. 4 and 5. FIG. 4 is a waveform diagram showing the behavior of an electric winch apparatus according to a comparative example, in which no prevention of irregular winding is conducted upon the landing of the suspended load 4 during the lowering operation of the suspended load 4. FIG. 5 is a waveform diagram showing the behavior of the electric winch apparatus according to the present embodiment in which the control for preventing irregular winding is conducted upon the landing of the suspended load during the lowering operation of the suspended load.

In FIGS. 4 and 5, the waveform (A) shows a time transition of the operation amount of the operation lever 13*a*, the waveform (B) shows a time transition of the speed command value, the waveform (C) shows a time transition of the average value of the tension in the wire rope 2 in a predetermined period, the waveform (D) shows a state of the brake 6, the waveform (E) shows a time transition of the rotational speed of the winch drum 5 when the suspended load 4 is lowered, and the waveform (F) shows a time transition of the vertical position of the hook 3.

Before the start of the lowering operation, that is, before a time t0, the suspended load 4 is under a stopped state. At this time, the operation lever 13*a* is at the neutral position and the brake 6 is under the braking state, thus the speed of the suspended load 4 being 0.

In this state, the lowering operation is given to the operation lever 13*a* at time t0 to displace the operation lever 13*a* in the lowering operation direction from the neutral position, and the winch control section 124 of the controller 12 accordingly brings the brake 6 from the braking state into the releasing state. Besides, in accordance with the lowering operation, the operation amount of the operation lever 13*a* indicated by the signal input from the operation lever device 13 to the winch control section 124 becomes negative and the absolute value thereof is increased. The controller 12, accordingly, starts the speed control of the electric motor 8 so as to make the rotational speed of the electric motor 8 be a rotational speed according to the operation amount of the operation lever 13*a*. Specifically, the current control section 122 of the controller 12 generates such a control signal as to make the rotational speed of the electric motor 8 be a rotational speed according to the operation amount of the operation lever 13*a* and inputs the generated control signal to the inverter 9. The inverter 9 having received the input of the control signal inputs, to the electric motor 8, a current which generates a torque necessary for executing the speed control. To the winch drum 5 is applied a torque obtained by reflecting a reduction ratio of the speed reducer 7 and an effect such as mechanical friction of the speed reducer 7 on the torque output by the electric motor 8. This causes the winch drum 5 to start rotating in the lowering direction at time t0 to thereby start lowering of the suspended load 4 according to the operation amount which is the displacement amount of the operation lever 13*a* in the lowering operation direction from the neutral position. In short, the hook 3 starts to have a position being lowered.

During thus lowering the suspended load 4 and the hook 3, that is, during the rotation of the winch drum 5 in the lowering direction, the current control section 122 of the controller 12 calculates a torque being applied to the winch drum 5 as a value corresponding to the tension in the wire rope 2, based on the value of current supplied to the electric motor 8 by the inverter 9, that is, the measured value provided by the ammeter 18, and calculates the average value of the torque in a predetermined period as an average value of the value corresponding to the tension in the wire rope 2 in the predetermined period.

After the lowering speed of the suspended load 4 reaches a target value at a time t1, the current control section 122 controls the rotational speed of the electric motor 8 so as to continue lowering the suspended load 4 while keeping the lowered speed of the target value.

Upon the landing of the suspended load 4 at a time t2, that is, the suspended load 4 reaches the ground, in more detail, the lower end of the suspended load 4 comes into contact with the ground, the speed of the suspended load 4 becomes 0. At this time, the tension in the wire rope 2 is abruptly decreased by a load of the suspended load 4. The lowering of the suspended load 4 is continued in this state and then the hook 3 goes into landing on the ground at a time t3. The hook 3, alternatively, may come into landing not on the ground but on the suspended load 4. In either case, the landing of the hook 3 prevents the load of the hook 3 from acting on the wire rope 2 to thereby decrease the tension in the wire rope 2 further abruptly.

In general, the operator conducts the work of bringing the suspended load 4 and the hook 3 into landing after reducing the operation amount of the operation lever 13*a* in the lowering operation direction to restrict the lowering of the suspended load 4 at a low speed in advance of the landing of the suspended load 4 lands to thereby preventing the tension in the wire rope 2 from being reduced abruptly as described above. However, there can be a case where the suspended load 4 and the hook 3 goes into landing when the speed thereof has not been decreased yet, for example, the case where the operator cannot recognize the landing to fail to reduce the operation amount of the operation lever 13*a* in the lowering operation direction, or the operation lever 13*a* is locked at a position deviated in the lowering operation direction from the neutral position by a detent mechanism in the operation lever device 13. In each of the cases, the tension in the wire rope 2 is abruptly reduced following the landing, as described above.

In the comparative example shown in FIG. 4, the speed command value is maintained at a value according to the operation amount of the operation lever 13*a* in the lowering direction regardless of the rapid reduction in the tension in the wire rope 2, the rotational speed of the winch drum 5 in the lowering direction being maintained according to the speed command value; this generates a possibility that the rapid reduction in the tension causes slack in the wire rope 2 to generate irregular winding of the wire rope 2 in the winch drum 5.

In contrast, according to the present embodiment shown in FIG. 5, at the time point where the average value of the tension in the wire rope 2 becomes less than or equal to the tension reference value smaller than the load corresponding to the weight of the hook 3, the winch control section 124 makes the speed command value to be input to the speed control section 121 be 0 to make the rotational speed of the winch drum 5 be 0 even though the operation lever 13*a* is operated in the lowering operation direction. This makes it possible to suppress slack in the wire rope 2 to thereby prevent irregular winding from occurring in the wire rope 2 in the winch drum 5.

As described above, the winch control section 124 of the controller 12 in the electric winch apparatus of the present embodiment conducts the control of causing the inverter 9 to stop the motion of the electric motor 8 so as to stop the rotation of the winch drum 5 in the lowering direction when the average value of the tension in the wire rope 2 in the predetermined period becomes less than or equal to the tension reference value during lowering of the suspended load 4 in the state where the operation lever 13*a* is operated in the lowering operation direction, thereby stopping the rotation of the winch drum 5 in the lowering direction upon the landing of the suspended load 4 and the hook 3 to reduce the tension in the wire rope 2 to suppress slack of the wire rope 2; this makes it possible to prevent irregular winding of the wire rope 2 from being caused upon the landing of the suspended load 4 and the hook 3.

In Addition, the tension reference value in the present embodiment as a judgement criterion for judging whether the stop processing of the electric motor 8 should be executed is set within a range smaller than the load corresponding to the weight of the hook 3; this enables the stop processing of the electric motor 8 to be executed reliably for preventing irregular winding of the wire rope 2 upon landing of the suspended load 4. Specifically, since the state where the average value of the tension in the wire rope 2 in the predetermined period is a value smaller than a load corresponding to the weight of the hook 3 corresponds a state of landing of the suspended load 4 and the hook 3 land, execution of the stop processing of the electric motor 8 when the average value of the tension in the wire rope 2 becomes less than or equal to the tension reference value predetermined as described above makes it possible to prevent irregular winding more reliably upon landing of the suspended load 4.

Besides, based on the value of the current to be supplied to the electric motor 8, the current value being measured by the ammeter 18, the controller 12 according to the present embodiment can calculate a torque to be applied to the winch drum 5 by the electric motor 8, with excellent precision, as a value corresponding to the tension in the wire rope 2. Based on the thus calculated value, the stop control of the electric motor 8 can be conducted with high precision for preventing irregular winding, of the wire rope 2.

The tension to be applied to the wire rope 2 can be indirectly estimated by, for example, measurement of the load applied to the derricking drum from the derricking rope with use of a load meter provided in a derricking drum for derricking a derricking member, such as a boom having a distal end from which a suspended load is suspends, through the derricking rope, or measurement of the load applied to the rotating shaft with use of a load cell or the like provided on a rotating shaft of a winch drum for lifting and lowering the suspended load. However, either of the measurements is not a direct measurement of the tension in the wire rope 2, being in capable of allowing the tension to be estimated with high precision. In contrast, the torque calculated as a value corresponding to the tension in the wire rope 2 by the controller 12 according to the embodiment is a value representing the value of the tension in the wire rope 2 more directly with higher precision than the estimation value of the tension in the wire rope 2 based on the above-described indirect measurement. This enables the stop control of the electric motor 8 according to the present embodiment to be conducted with high precision for preventing irregular winding of the wire rope 2 as described above.

Additionally, the controller 12 according to the embodiment, which releases the stop processing of the electric motor 8 by the inverter 9 when the operation amount of the operation lever 13*a* in the lowering operation direction becomes less than the operation amount reference value after executing the stop processing of the electric motor 8 for stopping the rotation of the winch drum 5 in the lowering direction, allows the operator to release the stop processing of the electric motor 8 by returning the operation lever 13*a* to the neutral position side, after the stop processing of the electric motor 8 is executed to stop the rotation of the winch drum 5 in the lowering direction, to make the operation amount of the operation lever 13*a* in the lowering operation direction be less than the operation amount reference value, and thereafter to re-cause the electric motor 8 to rotate the winch drum 5 in the lowering direction for drawing out the wire rope 2, or the like.

According to the electric winch apparatus of the present embodiment, in the case where the input device 20 does not conduct the stop input to the controller 12 in response to the operation by the operator, specifically, in the case of where the input device 20 conducts no input of the mode designation signal for designating the normal work mode or the free-fall mode, for example, in the case of inputting the mode designation signal which designates the draw-out mode, the controller 12 releases (cancels) the stop processing of the electric motor 8 for preventing irregular winding of the wire rope 2; this enables the operator to release the stop processing of the electric motor 8 according to his/her own will, for example, in the case where the execution of the stop processing of the electric motor 8 is not preferable in view of the work done in the crane.

The present invention is not limited to the foregoing, described embodiments. The present invention encompasses the following aspects.

The electric winch apparatus according to the present invention is widely applicable, not limited to a crane, to construction machines having a function of conducting lifting and lowering of a suspended load.

In the case where the electric winch apparatus according to the present invention includes an input device, the input device may have only a function of exclusively conducting stop input to a controller, that is, input for providing the instruction on execution of the stop processing of the electric motor 8 for preventing irregular winding of the wire rope 2, differently from the input device 20 according to the above embodiment which conducts input of designation of the motion mode. Also in this case, the controller can produce the same effects as those described above by executing stop processing of the electric motor when receiving the stop input and suspending the stop processing of the electric motor when not receiving the stop input.

Alternatively, it is also possible that the input device is configured to selectively input the stop input or an inhibition input for providing the instruction on inhibition of execution of the stop processing of the electric motor 8 to a controller and the controller is configured to execute the stop processing of the electric motor when receiving the stop input and to execute the stop processing when receiving the inhibition input. In this aspect, the case where the input device receives the inhibition input is one example of the case where the input device does not receive the stop input in the present invention.

The input device possible to be included in the electric winch apparatus according to the present invention is not limited to a touch panel type it is also possible that the input device includes an operation member such as a press button or an operation switch and is configured to input to a controller a signal for designating the motion mode of the electric motor and a signal for switching execution and non-execution of the stop processing of the electric motor based on the operation applied to the operation member. For example, in civil engineering work by use of a vibrohammer, clamshell or the like to be suspended through a wire rope, the tension in the wire rope is drastically changed irrespective of an operation amount of an operation lever. In this case, there can occur frequently an event that the average value of the tension in the wire rope becomes less than or equal to a tension reference value in a predetermined period and it is burdensome if an electric motor is stopped every time the event occurs. In such civil engineering work, an operator can avoid frequent stop of the electric motor by preventing the input device from conducting stop input, that is, input for providing the instruction on execution of the stop processing of the electric motor.

Means for obtaining a torque to be applied to the winch drum 5 is not limited to the calculation based on the measured value of a current to be supplied to the electric motor 8 as in the above embodiment. For example, the electric motor 8 may be provided with a torque meter which measures a torque to be applied by the electric motor 8 to the winch drum 5. The torque meter is one example of the measurement unit in the present invention and the torque measured by the torque meter is one example of the tension index value in the present invention. It is alternatively possible to measure a current value to be applied from the power source 10 to the inverter 9 with an ammeter and to calculate a torque to be applied to the winch drum 5 by the electric motor 8 from the measured current value. In this case, the ammeter is one example of the measurement unit in the present invention and the current value measured by the ammeter is one example of the tension index value in the present invention.

The ammeter 18 according to the above embodiment may be contained the inverter 9 or in the electric motor 8.

In the case of including adjusting electric power through consumption of a surplus portion of electric power that the power source cannot regenerate in the present invention, the consumption is not limited to consumption in the regenerative resistor 11 according to the above embodiment but also realized, for example, through charging a capacitance with the surplus portion of electric power or the use of the surplus portion of electric power for operation of other electric apparatuses.

Release conditions for releasing the stop processing of the electric motor to prevent irregular winding is not limited to that the motion mode of the electric winch apparatus is the draw-out mode and that the operation a of the operation lever in the lowering direction is less than an operation amount reference value; other conditions in place of or in addition to these conditions may be provided. The release conditions may include, for example, a condition that an operation is applied to the operation lever to return the operation lever having been operated in the lowering operation direction to the neutral position side and the speed of the position change of the operation lever receiving the operation is greater than or equal to a predetermined value.

In the present invention, the operation unit which receives operation for providing the instructions on lifting/lowering of a suspended load is not limited to an operation lever; it may be, for example, an operation button capable of receiving pressing operation to be displaced in a direction of the operation from a reference position, or an operation dial to be rotationally operated from the reference position or the like.

As described above, there is provided an electric winch apparatus capable of preventing irregular winding caused by landing of a lowered suspended load.

Provided is an electric winch apparatus to be mounted on a construction machine, the electric winch apparatus including: a winch drum around which a wire rope for suspending a suspended load is wound; an electric motor capable of rotating the winch drum by applying a torque to the winch drum in both of a lifting direction that is a rotational direction to lift up the suspended load and a lowering direction that is a rotational direction to lower the suspended load; an operation unit displaceable, from a reference position, in both of a lifting operation direction that is an operation direction for providing instruction on lifting up the suspended load and a lowering operation direction that is an operation direction for providing instruction on lowering the suspended load, the operation unit being configured to receive an operation of a lifting operation that displaces the operation unit in the lifting operation direction and a lowering operation that displaces the operation unit in the lowering operation direction; a measurement unit that measures a tension index value that is an index value of a tension in the wire rope; and a controller that controls a motion of the electric motor to rotate the winch drum in the lifting direction or the lowering direction according to the operation applied to the operation unit. The controller executes stop processing of stopping the motion of the electric motor in a case where a tension average value that is an average value of a tension in the wire rope becomes less than or equal to a predetermined tension reference value, the average value of the tension corresponding to an average value of the tension index value measured by the measurement unit in a predetermined period, in a state that the operation unit is operated in the lowering operation direction.

The controller according to the electric winch apparatus stops the motion of the electric motor to stop the rotation of the winch drum in the lowering direction when the average value of the tension in the wire rope in the predetermined period becomes less than or equal to a tension reference value due to the landing of the suspended load during the lowering operation given to the operation unit to lower the suspended load, so that, thereby suppressing slack of the wire rope due to reduction in the tension in the wire rope following the landing of the suspended load, which makes it possible to prevent irregular winding, of the wire rope from being caused upon the landing of the suspended load.

Preferably, the electric winch apparatus further includes a hook connected to the wire rope, the hook allowing the suspended load to be hooked on the hook, and the tension reference value is a value smaller than a load corresponding to a weight of the hook.

Setting of such a tension reference value as described above enables the stop processing of the electric motor to be reliably executed for preventing irregular winding of the wire rope upon landing of the suspended load. Since the state where the average value of the tension in the wire rope in the predetermined period is less than the load of the hook corresponds a state where the suspended load and the hook suspending the suspended load is landing, the stop processing of the electric motor can be more reliably executed for preventing irregular winding upon the landing of the suspended load in the state.

In the electric winch apparatus, it is preferable that the measurement unit is an ammeter which sequentially measures a value of a current to be supplied to the electric motor as the tension index value and the controller calculates a torque to be applied to the winch drum by the electric motor based on a current value measured by the ammeter and calculates an average value of the calculated torque in the predetermined period as a value corresponding to the average value of the tension in the wire rope.

This configuration allows the value corresponding to the average value of the tension in the wire rope to be calculated with excellent precision, thus improving the precision of the stop control of the electric motor based on the calculated value. Although the tension in the wire rope can be estimated also from, for example, the value of the load applied to a member such as a derricking rope and measured by a load meter attached to the member, the member being one that holds a position of a derricking member such as a boom of a crane, or from a value of a load applied to a derricking drum measured by a load meter attached to the derricking drum, the derricking drum causing the derricking member to rise and lower via the derricking rope, the precision of the thus estimated value is lower than that of a value obtained by direct measurement of a tension in the wire rope. The torque calculated by the controller has a value which indicates a tension value of the wire rope more directly and with higher precision as compared with the estimation value as described above. Based on such an average value of these values, the stop control of the electric motor can be executed with higher precision for preventing irregular winding of the wire rope.

The controller preferably releases the stop processing in a case where an operation amount that is an amount of displacement of the operation unit, in the lowering operation direction becomes less than a predetermined operation amount reference value after the stop processing is executed.

The release of the stop processing enables an operator to release the stop processing of the electric rotor by returning the operation unit to the reference position side to make the operation amount of the operation unit in the lowering operation direction be less than the operation amount reference value after the rotation of the winch drum in the lowering direction is stopped by the stop processing of the electric motor, and further to re-cause the electric motor to rotate the winch drum in the lowering direction to conduct drawings out of the wire rope or the like.

It is preferable that the electric winch apparatus further includes an input device capable of inputting a stop input for providing instruction on execution of the stop processing to the controller and the controller is configured to execute the stop processing when receiving the stop input from the input device and to suspend the stop processing when not receiving the stop input.

The combination of the input device and the controller enables an operator to release the stop processing of the electric motor for preventing irregular winding of the wire rope by suspending stop input to the controller by use of the input device. This allows the operator to release the stop processing of the electric motor by his/her own will, for example, in a case where the stop processing of the electric motor is non-preferable for the work conducted by the construction machine.

The invention claimed is:

1. An electric winch apparatus mounted on a construction machine, comprising:

a winch drum around which a wire rope for suspending a suspended load is wound;

an electric motor capable of rotating the winch drum by applying a torque to the winch drum in both of a lifting direction that is a rotational direction to lift up the suspended load and a lowering direction that is a rotational direction to lower the suspended load;

an operation unit displaceable, from a reference position, in both of a lifting operation direction that is an operation direction for providing instruction on lifting up the suspended load and a lowering operation direction that is an operation direction for providing instruction on lowering the suspended load, the operation unit being configured to receive an operation of a lifting operation that displaces the operation unit in the lifting operation direction and a lowering operation that displaces the operation unit in the lowering operation direction;

a measurement unit that measures a tension index value that is an index value of a tension in the wire rope; and a controller that controls a motion of the electric motor to rotate the winch drum in the lifting direction or the lowering direction according to the operation applied to the operation unit, wherein the controller executes stop processing of stopping the motion of the electric motor in a case where a tension average value that is an average value of a tension in the wire rope becomes less than or equal to a predetermined tension reference value, the average value of the tension corresponding to an average value of the tension index value measured by the measurement unit in a predetermined period, in a state that the operation unit is operated in the lowering operation direction.

2. The electric winch apparatus according to claim 1, further comprising a hook connected to the wire rope, the hook allowing the suspended load to be hooked on the hook, the tension reference value being a value smaller than a load corresponding to a weight of the hook.

3. The electric winch apparatus according to claim 1, wherein the measurement unit is an ammeter which sequentially measures a value of a current to be supplied to the electric motor as the tension index value, and the controller calculates a torque to be applied to the winch drum by the electric motor based on a current value measured by the ammeter and calculates an average value of the torque calculated in the predetermined period as a value corresponding to the average value of the tension in the wire rope.

4. The electric winch apparatus according to claim 1, wherein the controller releases the stop processing in a case where an operation amount as an amount of displacement of the operation unit from a neutral position in the lowering operation direction becomes less than a predetermined operation amount reference value, after the stop processing is executed.

5. The electric winch apparatus according to claim 1, further comprising an input device capable of inputting a stop input for providing instruction on execution of the stop processing to the controller, wherein the controller executes the stop processing when receiving the stop input from the input device and suspends the stop processing when not receiving the stop input.

* * * * *